US006553700B1

(12) United States Patent
Hirayama et al.

(10) Patent No.: US 6,553,700 B1
(45) Date of Patent: Apr. 29, 2003

(54) METAL CAN LABEL AND METAL CAN HAVING METAL CAN LABEL APPLIED THERETO

(75) Inventors: Masakazu Hirayama, Osaka (JP); Takahiro Nakagawa, Osaka (JP); Yoshinori Hotta, Sakai (JP)

(73) Assignee: Fuji Seal Inc., Osaka (JP)

( * ) Notice: Subject to any disclaimer, the term of this patent is extended or adjusted under 35 U.S.C. 154(b) by 0 days.

(21) Appl. No.: 09/830,823

(22) PCT Filed: Aug. 30, 2000

(86) PCT No.: PCT/JP00/05845

§ 371 (c)(1), (2), (4) Date: May 1, 2001

(87) PCT Pub. No.: WO01/16924

PCT Pub. Date: Mar. 8, 2001

(30) Foreign Application Priority Data

Sep. 1, 1999 (JP) ..... 11-248035

(51) Int. Cl.[7] ..... G09F 3/04; G09F 3/10
(52) U.S. Cl. ..... 40/630; 40/306
(58) Field of Search ..... 40/630, 638, 306, 40/307, 310

(56) References Cited

U.S. PATENT DOCUMENTS 2,953,865 A * 9/1960 Heuser ..... 40/638
4,246,709 A * 1/1981 Selleslags ..... 40/310

FOREIGN PATENT DOCUMENTS

JP A7271305 10/1995
JP A844295 2/1996
JP 411157545 A * 6/1999
JP 411157546 A * 6/1999
JP 11272172 A * 10/1999

* cited by examiner

*Primary Examiner*—William L. Miller
(74) *Attorney, Agent, or Firm*—Birch, Stewart, Kolasch & Birch, LLP

(57) ABSTRACT

A metal-can label is bonded to a metal can by heating. The label has a thermally stable transparent label substrate; and adhesive layer composed of a thermosetting resin; and either a printer layer or a deposited metal layer or both. These layers are formed between the transparent label layer and the adhesive layer. The label has, at its edge, a clear portion having a predetermined width in which the transparent label substrate and the adhesive layer are laminated without the interposition of either the print layer or the deposited metal layer. A can having rolled top covering the clear portion of the label is described.

8 Claims, 3 Drawing Sheets

METAL CAN LABEL AND METAL CAN HAVING METAL CAN LABEL APPLIED THERETO

This application is the national phase under 35 U.S.C. §371 of PCT International Application No. PCT/JP00/05845 which has an International filing date of Aug. 30, 2000, which designated the United States of America and was not published in English.

TECHNICAL FIELD

The present invention relates to a metal-can label which is bonded to a metal can by heating adhesion and to a metal can carrying the metal-can label. Specifically, the present invention relates to a metal-can label that is resistant to peeling-off even when a metal can carrying the label undergoes, for example, drawing or retorting, and to a metal can carrying this metal-can label.

BACKGROUND ART

Metal cans include beverage cans that are filled with beverages such as soft drinks and beer, and spray cans that are filled with gases. These metal cans are classified as a three-piece can composed of a can body, a can bottom and a can lid, and a two-piece can composed of a can bottom and a can body formed as an integral can main body and a can lid fitted onto the can main body. In some cans, the neck of such a can main body is subjected to neck-in processing to form plural steps, and this type of cans have been used in large numbers in recent years.

When an external ornament such as a trade name, a manufacturer name, and a design (pattern) is made on a metal can such as a two-piece can or a three-piece can, the external ornament is generally printed directly onto the outer surface of the body of can main body. However, the outer surface of the body of metal can (two-piece can) to be printed generally curves cylindrically and is lower in printability than a conventional film printing, and a beautiful finishing cannot be significantly obtained. Particularly, color printing such as photomechanical printing which requires precise processes invites many problems, and there is a limitation when a satisfactory external ornament is to be made on a metal can by direct printing on the outer surface of the can body.

Consequently, an attempt has been made to yield an improved ornament by allowing the body of a metal can to carry a shrink label. However, shrinkage of the shrink label becomes uneven in, for example, neck-in processed portions, to invite deformation or rupture in the top edge or bottom edge of the shrink label, and the shrink label peels off from the metal can. Additionally, the shrink label is not bonded to the body surface of metal can, and when the shrink label reaches the rolled portion, the shrink label which is not bonded disadvantageously weakens the rolling strength.

Under these circumstances, as a metal-can label that can yield satisfactory external ornament, adhesive label 21 as shown in FIG. 9 has been discussed. Adhesive label 21 includes transparent label substrate 22, and print layer (or deposited metal layer) 23 and adhesive layer 24 composed of a thermosetting resin successively laminated on transparent label substrate 22. FIG. 10 is a sectional view showing the top of can main body 10. In this state, a metal can carrying aforementioned adhesive label 21 on its can body has been further subjected to neck-in processing. Adhesive label 21 can be surely affixed to the surface of the can body of metal can by heating adhesion, and does not deteriorate the rolling strength even when the adhesive label reaches the rolled portion. However, if the neck of the can body is subjected to extreme drawing (neck-in processing), stress is applied to attached label 21 in neck-in processed portion 10*c*, and the it top edge of the label peels off, as shown in FIG. 10. This peeling-off is generally occurs in the interface between print layer (or deposited metal layer) 23 and adhesive layer 24. Additionally, when the metal can carrying label 21 is subjected to hot water treatment or retorting, water or moisture enters the edge of label to invite the label to peel off.

DISCLOSURE OF THE INVENTION

Accordingly, an object of the present invention is to provide a metal-can label that can bear a satisfactory external ornament, can be surely affixed to the outer surface of the body of a metal can, and is resistant to peeling-off even when the metal can is subjected to extreme drawing or to hot water treatment or retorting, as well as to provide a metal can carrying the metal-can label.

After intensive investigations to achieve the above objects, the present inventors found that the formation of a clear portion having neither print layer nor deposited metal layer at the edge of a label make the label to be resistant to peeling-off even when a metal can carrying the label is subjected to extreme drawing or to retorting. The present invention has been accomplished based on these findings.

Specifically, the present invention provides a metal-can label to be bonded to a metal can by heating. The label includes a thermally stable transparent label substrate, an adhesive layer composed of a thermosetting resin, and at least one layer selected from a print layer and a deposited metal layer each formed between the transparent label layer and the adhesive layer, and the label has, at its edge, a clear portion having a predetermined width, in which the transparent label substrate and the adhesive layer are laminated without the interposition of any of the print layer and the deposited metal layer. In this label, the transparent label substrate may be made of a biaxially oriented polyester-based resin film, and the adhesive layer may be made of a thermosetting polyester-based resin.

In another aspect, the present invention provides a metal can which carries the metal-can label on the outer surface of a can body by action of heating adhesion. The metal can carrying the metal-can label on the outer surface of a can body by action of heating adhesion may be further subjected to neck-in processing. The metal can may carry the metal-can label on the outer surface of the can body in such a manner that the clear portion of the label is hidden by a rolled portion of the top of the can body and a can lid.

BEST MODE FOR CARRYING OUT THE INVENTION

Figure 1:
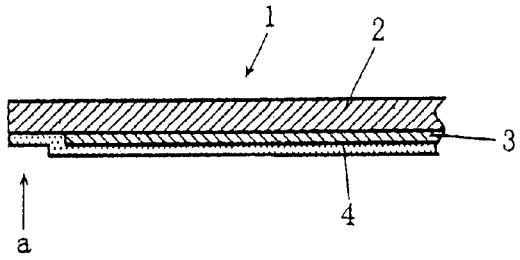
FIG. 1 is a sectional view showing an embodiment of a metal-can label according to the present invention.

The embodiments of the present invention will be illustrated in detail with reference to the drawings. In the drawings, the same members or portions have the same reference numerals.

FIG. 1 is a schematic sectional view showing an embodiment of a metal-can label according to the present invention. Metal-can label 1 is an external label that is heated and bonded to a body (can body) of a can main body constituting a metal can. Such metal cans include beverage cans such as coffee cans and beer cans, or spray cans. Metal-can label 1 is composed of transparent label substrate 2, adhesive layer 4, and print layer 3 sandwiched between label substrate 2 and adhesive layer 4. Transparent label substrate 2 is made of a thermally stable synthetic resin film that barely shrinks at heating temperatures in heating adhesion to the can main body (i.e., the film does not substantially shrink outwardly by adhesion operation to the can main body). At the edge of label 1, clear portion a is formed in a predetermined width, in which label substrate 2 and adhesion layer 4 are directly laminated without the interposition of print layer 3.

As label substrate 2, transparent synthetic resin films having heat resistance that is stable against heat when the label is heated and bonded to the body of can main body may be used. Such synthetic resin films include, films of polyesters such as poly(ethylene terephthalate), poly(butylene terephthalate), and poly(ethylene naphthalate), and films composed of laminated polyester-based resins. The film may be any of non-oriented film or uniaxially or biaxially oriented film, but an oriented film, especially, a biaxially oriented film is often used. Label substrate 2 is preferably made of a biaxially oriented polyester-based resin film having typically satisfactorily stable dimensions. The thickness of label substrate 2 can be appropriately selected within a range not deteriorating strengths and heat resistance (thermal stability) as a substrate and workability in adhesion operation and external appearance as a label, and is generally from about 5 to about 50 $\mu$m, and preferably from about 9 to about 25 $\mu$m.

Print layer 3 is formed in the following manner. A character or pattern, for example, is formed in a portion of the surface of label substrate 2 other than clear portion a, using an ink containing a coloring pigment and utilizing a known printing technique such as gravure printing, flexographic printing, and offset printing. Particularly, print layer 3 is preferably formed by gravure printing using a thermally stable ink such as a two-pack curable ink containing a polyester-urethane-based resin component. Print layer 3 has a thickness of, for example, from about 1 to about 8 $\mu$m, and preferably from about 2 to about 5 $\mu$m.

Adhesive layer 4 is composed of a thermosetting resin. Such thermosetting resins include, but are not limited to, epoxy resins, phenolic resins, aminoplast resins, thermosetting polyester-based resins, urethane-based resins, or mixtures of these resins (e.g., epoxy-phenol resins and polyester-isocyanate-based resins). Among them, epoxy resins and thermosetting polyester-based resins are preferred for their satisfactory heat resistance, adhesion, and workability, of which thermosetting polyester-based resins are typically preferred for their satisfactory workability in adhesion operation. Adhesive layer 4 can be formed by applying a solution mainly containing such a thermosetting resin composition onto print layer 3 (or label substrate 2 in clear portion a) to a dried thickness of, for example, 0.5 to 20 $\mu$m, using a conventional coating technique such as gravure coating.

The width of clear portion a is preferably wide from the viewpoint of the prevention of peeling-off, but is preferably as narrow as possible from viewpoint of external ornament quality of the resulting product in order to hide the ground surface of the can as intact. Specifically, the width is preferably a width that can be hidden by the rolled portion of the top edge of the can body and a can lid. Considering these points, the width (distance from the edge of label 1) of clear portion a is preferably not more than 3 mm (e.g., from 0.2 to 3 mm), more preferably from about 0.5 to about 2.8 mm, and specifically preferably from about 1 to about 2.8 mm.

Figure 2:
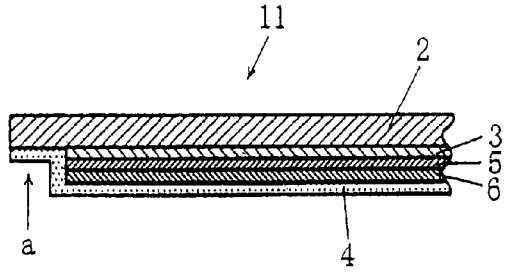
FIG. 2 is a sectional view showing another embodiment of a metal-can label according to the present invention.

FIG. 2 is a schematic sectional view showing another embodiment of the invented metal-can label. Metal-can label 11 is composed of transparent label substrate 2, and print layer 3, anchor coat layer 5, deposited metal layer 6 and adhesive layer 4 sequentially laminated on one side of label substrate 2. At the edge of label 11, clear portion a is formed in a predetermined width, in which label substrate 2 and adhesive layer 4 are directly laminated without the interposition of any of print layer 3 and deposited metal layer 6.

The configurations of label substrate 2, print layer 3 and adhesive layer 4 are the same as described above. Incidentally, print layer 3 in this embodiment may be formed entirely or partially in a portion other than clear portion a, or no print layer 3 may be formed.

Anchor coat layer 5 may be composed of any of a non-curable resin, a thermosetting resin, an ultraviolet-curable resin and the like. When anchor coat layer 5 is composed of a thermosetting resin, this layer can be formed, for example, in the following manner. Initially, a resin composition containing a thermosetting resin such as an isocyanate resin, epoxy resin or polyester-based resin or a mixture of these resins is applied or printed onto print layer 3 by the use of a conventional application means or printing means such as a gravure coater, and the applied resin composition is cured by heat to form layer 5. When anchor coat layer 5 is composed of an ultraviolet-curable resin, this layer can be formed in the following manner. Initially, an ultraviolet-curable composition containing an oligomer (a photopolymerizable prepolymer), a photopolymerization initiator, and, according to necessity, a monomer (a photopolymerizable diluent), a sensitizer, a non-reactive resin, a filler, and other additives is applied or printed onto print layer 3 using a conventional application means or printing means such as a gravure coater, and the applied composition is dried and is cured by the irradiation with ultraviolet rays to form layer 5.

When anchor coat layer 5 is composed of a thermosetting resin or ultraviolet-curable resin, the resulting anchor coat layer 5 is not softened by heat when metal-can label 11 is heated and bonded to a metal can or in case of retorting (pressure-heat sterilization) in, for example, a coffee can. This configuration does not invite disadvantages such that deposited metal layer 6 is misregistered with respect to label substrate 2 or is deformed to lose metallic luster with softened anchor coat layer 5.

The thickness of anchor coat layer 5 can be appropriately selected within a range not deteriorating adhesion to deposited metal layer 6 or the brightness of metallic luster, and is generally from about 0.3 to about 3 $\mu$m.

Deposited metal layer 6 is formed by subjecting aluminium to a conventional vapor deposition technique such as vacuum deposition to a thickness from 300 to 1000 angstroms. This layer may be formed with the interposition of a clear colored ink layer so as to be seen from the outside of label substrate 2. As a base material to be deposited, chromium, silver, copper, tin, and other metals can be employed, in addition to aluminium.

In the clear portion of the invented metal-can label, the transparent label substrate and the adhesive layer have only to be laminated without the interposition of any of the print layer and the deposited metal layer, and the two layers may not be necessarily laminated directly. For example, a thin film layer such as an anchor coat layer or a primer coat layer each containing substantially no pigment may be sandwiched between the transparent label substrate and the adhesive layer.

Figure 3:
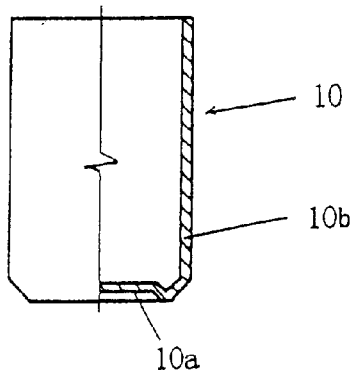
FIG. 3 is a partially sectional view showing a can main body as intact.
Figure 4:
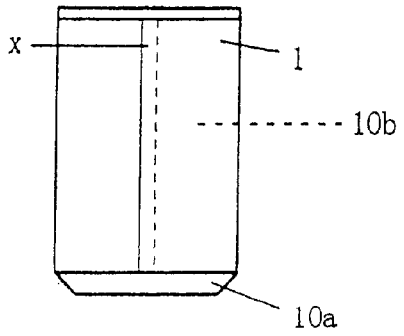
FIG. 4 is a side view showing a can main body carrying the metal-can label shown in FIG. 1.
Figure 5:
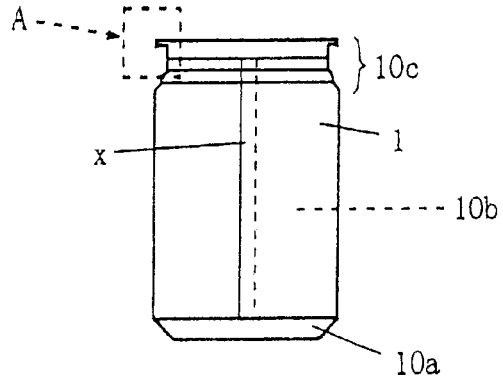
FIG. 5 is a side view showing the can main body which has been further subjected to neck-in processing.
Figure 6:
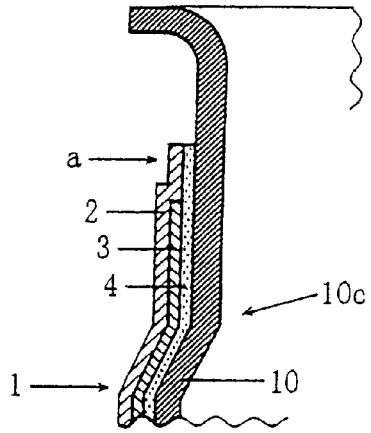
FIG. 6 is a sectional view showing the top (portion A) of the can main body shown in FIG. 5.
Figure 7:
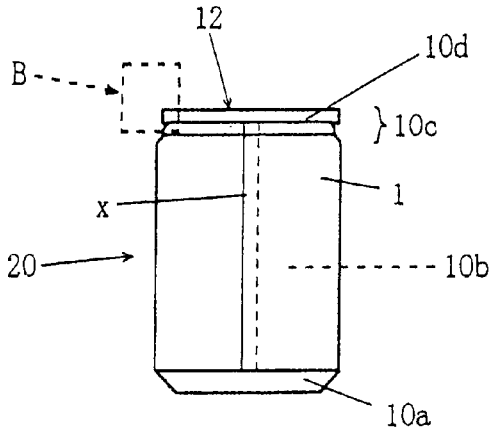
FIG. 7 is a side view showing a metal can comprising the can main body shown in FIG. 5 and a can lid fitted to the can main body.

A metal can carrying metal-can label 1 having the above configuration can be produced in the following manner. FIG. 3 is a partially sectional view showing an embodiment of a can main body as intact; FIG. 4 is a side view showing a can main body carrying the metal-can label shown in FIG. 1; FIG. 5 is a side view showing the can main body which has been further subjected to neck-in processing; FIG. 6 is a sectional view showing the top (portion A) of the can main body shown in FIG. 5; FIG. 7 is a side view showing a metal can comprising the can main body shown in FIG. 5 and a can lid mounted to the can main body; and FIG. 8 is a sectional view showing the top (portion B) of the metal can shown in FIG. 7.

Can main body 10 is formed as an integral part of can bottom 10*a* and tubular can body 10*b* by subjecting a surface-treated steel sheet to deep drawing-ironing, as shown in FIG. 3. Initially, can main body 10 is heated at, for example, about 80° C. to about 180° C., and metal-can label 1 is placed and is bonded by pressing around the outer surface of can body 10*b* of can main body 10, in such a manner that clear portion a is located on top and adhesion layer 4 is located inside, as shown in FIG. 4. In this procedure, the top edge of metal-can label 1 may be aligned with the top edge of can body 10*b*. However, metal-can label 1 is preferably bonded in such a manner that the top edge thereof is positioned from about 0.1 to about 1.0 mm (preferably from about 0.2 to about 0.8 mm) below the top edge of can body 10*b*, since the position of the label attached by a labeler varies and the rolling operation of the can lid may be adversely affected when the label extends off the top edge of the can. Additionally, in this procedure, a double-rolled portion X is formed, in which the beginning of rolling of metal-can label 1 is overlapped with the termination of rolling in a range of several millimeters to thereby ensure metal-can label 1 to cover the entire surface of the body of can main body 10. Subsequently, the label is heated by, for example, hot air at a temperature from 100° C. to 220° C. or higher for several seconds to several ten minutes to completely cure adhesive layer 4 to thereby finish adhesion operation.

Next, as shown in FIG. 5 and FIG. 6, the top of can body 10*b* after heating adhesion of metal-can label 1 is subjected to neck-in processing to form neck-in portion 10*c* in which the diameter narrows once or plural times.

Figure 8:
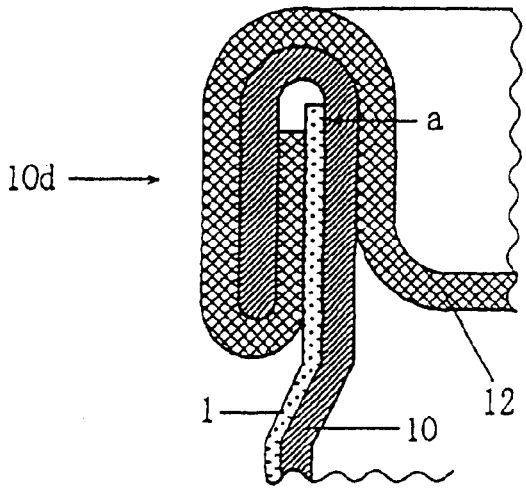
FIG. 8 is a sectional view showing the top (portion B) of the metal can shown in FIG. 7.
Figure 9:
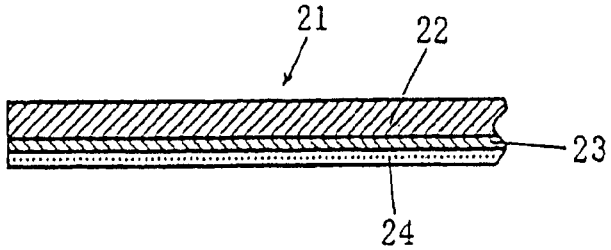
FIG. 9 PRIOR ART
FIG. 9 is a sectional view showing a conventional metal-can label.
Figure 10:
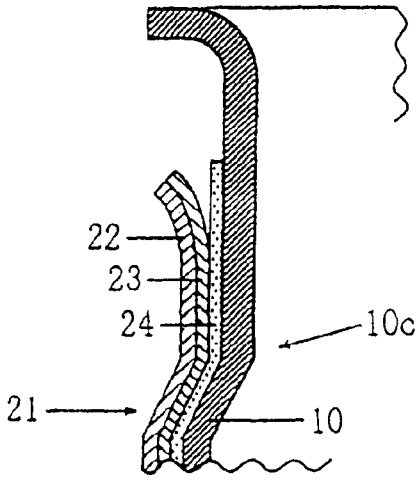
FIG. 10 PRIOR ART
FIG. 10 is a sectional view showing the top of a can main body carrying the conventional metal-can label and being further subjected to neck-in processing.

Can main body 10 having the neck-in portion thus formed is delivered to a factory in which the contents such as soft drinks are manufactured, and the contents are charged into can main body 10, and can lid 12 prepared separately is firmly integrated with the edge of neck-in portion 10*c* by rolling (winding) treatment to thereby form sealed metal can 20, as shown in FIG. 7 and FIG. 8. Can lid 12 generally undergoes a treatment for the formation of an opening for drinking, such as a pull tab (not shown in the figure).

A metal can carrying metal-can label 11 may be produced in a similar manner.

Metal can 20 thus formed is subjected to neck-in processing after heating adhesion of metal-can label 1 (or 11) having print layer 3 (and/or deposited metal layer 6) around the outer surface of can main body 10. It can therefore be easily decorated with a precise and beautiful external ornament, as compared with a conventional metal can in which an ornament is directly printed onto the surface of curved can main body 10.

Additionally, metal-can label 1 (or 11) is completely bonded to the surface of can main body 10, and metal can 20 having a satisfactory external ornament and being satisfactory sealed can be obtained without deterioration in rolling strength, even when metal-can label 1 reaches rolled portion 10*d* so as to hide the ground surface of can main body 10 as intact.

In particular, label 1 (or 11) has, at its edge, clear portion a in which label substrate 2 and adhesive layer 4 are laminated without the interposition of any of print layer 3 and deposited metal layer 6, and label substrate 2 and adhesive layer 4 are firmly bonded to each other in clear portion a. Consequently, label 1 (or 11) is highly resistant to peeling-off even when can main body 10 carrying label 1 (or 11) is subjected to extreme drawing. Furthermore, when the metal can carrying label 1 (or 11) is subjected to hot water treatment or retorting, water does not enter from the edge face of the label, and label 1 (or 11) is resistant to peeling-off.

In this connection, clear portion a includes neither print layer 3 nor deposited metal layer 6 to thereby reveal the bare surface (ground surface) of can, but this portion can be hidden by rolled portion 10*d* of the top edge of can body 10*b* and can lid 12, by adjusting the position of bonded clear portion a. Thus, the external ornament is never deteriorated.

A two-piece steel can made of a surface-treated steel sheet is illustrated in the above embodiments, but, needless to say, the present invention can also be applied to conventional DI (drawing and ironing) cans and aluminium cans. The present invention is specifically useful and advantageous for beverage cans and spray cans.

Industrial Applicability

According to the present invention, a label has, at its edge, a clear portion in which a transparent label substrate and an adhesive layer are laminated without the interposition of any of print layer and deposited metal layer, and the label does not peel off even when a metal can carrying the label is subjected to neck-in processing or to hot water treatment or retorting.

EXAMPLES

The present invention will be illustrated in further detail with reference to an example below, which is not intended to limit the scope of the invention.

Example

Gravure printing was performed to a thickness from 3 to 4 μm on one side of a biaxially oriented poly(ethylene terephthalate) (PET) film having a thickness of 12 μm to form a character or a design (pattern), excluding a 2-mm width portion (clear portion) from the edge of the film. Next, a thermosetting polyester adhesive was applied to a thickness of 1.8 g/m$^2$ on the print layer (on the PET film in the clear portion) to form an adhesive layer to thereby yield a metal-can label.

A steel can main body, in which a can bottom and a can body were molded as an integral part, was heated to a temperature of 130° C. or more, and the body was pressed against the surface of the adhesive layer of the above-prepared label to affix the label thereto. The can carrying the label was heated so as to maintain the temperature of can at 210° C. for one minute to thereby cure the adhesive layer. The top of the can main body was then subjected to neck-in processing, but neither shriveling nor peeling-off of the top edge occurred in the label. The neck-in processed can main body was exposed to steam at 130° C. for 30 minutes, and the label was still firmly bonded to the surface of the can without peeling-off of the top edge thereof.

What is claimed is:

1. A metal can comprising a can body carrying a label on the outer surface of the can body by action of heating adhesion wherein said metal can is further subjected to neck-in processing;

said label comprising a thermally stable transparent label substrate, and adhesive layer composed of a thermosetting resin, and at least one intermediate layer selected from the group consisting of a print layer and a deposited metal layer between said transparent label substrate and said adhesive layer;

said label having, at its edge, a clear portion having a predetermined width in which said transparent label substrate and said adhesive layer are laminated without the interposition of any of said print layer and said deposited metal layer.

2. The metal can of claim 1, wherein the top of the can body has a rolled portion and said metal can carries the label on the outer surface of the can body in such a manner that the clear portion of the label is hidden by the rolled portion of the top of the can body and a can lid.

3. The metal can of claim 1, wherein the thermosetting resin is a thermosetting polyester-based resin.

4. The metal can of claim 1, wherein the intermediate layer comprises the print layer.

5. The metal can of claim 1, wherein the intermediate layer comprises the deposited metal layer.

6. The metal can of claim 1, wherein the intermediate layer comprises the print layer and the deposited metal layer.

7. The metal can of claim 1, wherein the intermediate layer comprises a plurality of said print layers and/or a plurality of said deposited metal layers.

8. The metal can of claim 1, wherein said label comprises an anchor coat layer between said transparent label substrate and said adhesive layer.

* * * * *